US010661948B2

(12) United States Patent
Shimono

(10) Patent No.: US 10,661,948 B2
(45) Date of Patent: May 26, 2020

(54) STANDING POUCH WITH STEAM RELEASE

(71) Applicant: TOPPAN PRINTING CO., LTD., Taito-ku, Tokyo (JP)

(72) Inventor: Takahiro Shimono, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

(21) Appl. No.: 16/172,299

(22) Filed: Oct. 26, 2018

(65) Prior Publication Data

US 2019/0062002 A1 Feb. 28, 2019

Related U.S. Application Data

(63) Continuation of application No. PCT/JP2017/020100, filed on May 30, 2017.

(30) Foreign Application Priority Data

Jun. 2, 2016 (JP) ..... 2016-111275
Jun. 2, 2016 (JP) ..... 2016-111276

(51) Int. Cl.
*B65D 33/01* (2006.01)
*B65D 75/00* (2006.01)
(Continued)

(52) U.S. Cl.
CPC ..... *B65D 33/01* (2013.01); *B65D 75/008* (2013.01); *B65D 75/5805* (2013.01);
(Continued)

(58) Field of Classification Search
USPC ..... 426/107
See application file for complete search history.

(56) References Cited

U.S. PATENT DOCUMENTS 4,692,291 A * 9/1987 Angell, Jr. ..... B29C 41/08 264/102
6,085,906 A * 7/2000 Lambert ..... B65B 31/00 206/524.8
(Continued)

FOREIGN PATENT DOCUMENTS

JP 2013-151317 A 8/2013
JP 2016-074457 A 5/2016
WO WO 2013/133092 A1 9/2013

OTHER PUBLICATIONS

Extended European Search Report dated Oct. 15, 2019, in European Patent Application No. 17806682.5, 10 pages.
(Continued)

*Primary Examiner* — J. Gregory Pickett
*Assistant Examiner* — Tia Cox
(74) *Attorney, Agent, or Firm* — Squire Patton Boggs (US) LLP

(57) ABSTRACT

A pouch includes two sheets placed one upon another, a seal, and a non-sealed portion. The seal includes a first seal portion and a second seal portion. The first seal portion extends along an edge of the two sheets. The second seal portion is depressed toward the accommodation cavity. The second seal portion includes a distal end portion and a connection portion. The distal end portion is configured to be ripped by stress concentration that occurs when steam generated from the contents raises pressure of the accommodation cavity. The connection portion is configured to connect the distal end portion and the first seal portion. The connection portion includes a ripping restriction portion configured to restrict ripping of the second seal portion that progresses from the distal end portion toward the first seal portion.

10 Claims, 6 Drawing Sheets

(51) Int. Cl.

| | |
|---|---|
| ***B65D 77/22*** | (2006.01) |
| ***B65D 75/58*** | (2006.01) |
| ***B65D 79/00*** | (2006.01) |
| *B65D 81/34* | (2006.01) |

(52) U.S. Cl.
CPC ..... *B65D 77/225* (2013.01); *B65D 79/005* (2013.01); *B65D 81/3461* (2013.01); *B65D 2205/00* (2013.01)

(56) References Cited

U.S. PATENT DOCUMENTS

| | | | | |
|---|---|---|---|---|
| 2003/0148004 | A1* | 8/2003 | Kawaguchi | A61J 1/10 426/115 |
| 2009/0314773 | A1* | 12/2009 | Kanzaki | B65D 77/225 219/733 |
| 2011/0100983 | A1* | 5/2011 | Han | B65D 33/01 219/725 |
| 2013/0048636 | A1* | 2/2013 | Mack | B65D 77/225 220/203.16 |
| 2014/0363104 | A1* | 12/2014 | Kondo | B65D 75/008 383/45 |
| 2015/0126349 | A1* | 5/2015 | Ishihara | B65D 75/008 493/194 |
| 2016/0272402 | A1 | 9/2016 | Kondo et al. | |

OTHER PUBLICATIONS

International Preliminary Report on Patentability dated Dec. 4, 2018, in International Patent Application No. PCT/JP2017/020100, 8 pages.

* cited by examiner

STANDING POUCH WITH STEAM RELEASE

BACKGROUND

The present disclosure relates to a pouch used to heat its contents.

A pouch that allows for heating of its contents is known in the art. The pouch includes a structure that releases steam, which is generated from the contents when heated, from the pouch. WO2013/133092 describes an example of a pouch including a side seal with a depression that is depressed toward an accommodation cavity of the pouch. When heating the pouch with a heating means such as a microwave oven, the interior pressure of the accommodation region rises and rips the seal thereby forming an opening in the depression so that steam is released through the opening and out of the pouch.

SUMMARY

When the pouch is tilted after being heated, a large amount of the contents may leak out of the opening formed in the depression.

It is an object of the present disclosure to provide a pouch that avoids a situation in which a large amount of the contents leaks out of the opening formed in the depression.

To achieve the above object, a pouch according to one aspect of the present disclosure includes two sheets placed one upon another, a seal, and a non-sealed portion. The seal includes a first seal portion and a second seal portion. The first seal portion extends along an edge of the two sheets and seals the two sheets together to form an accommodation cavity between the two sheets that allows for accommodation of contents. The second seal portion is shaped to be depressed toward the accommodation cavity. The non-sealed portion is a portion in the two sheets surrounded by the second seal portion and not sealed. The second seal portion includes a distal end portion and a connection portion. The distal end portion is configured to be ripped by stress concentration that occurs when steam generated from the contents raises pressure of the accommodation cavity. The connection portion is configured to connect the distal end portion and the first seal portion. The connection portion includes a ripping restriction portion configured to restrict ripping of the second seal portion that progresses from the distal end portion toward the first seal portion.

DESCRIPTION OF EXEMPLARY EMBODIMENTS

First Embodiment

Figure 1:
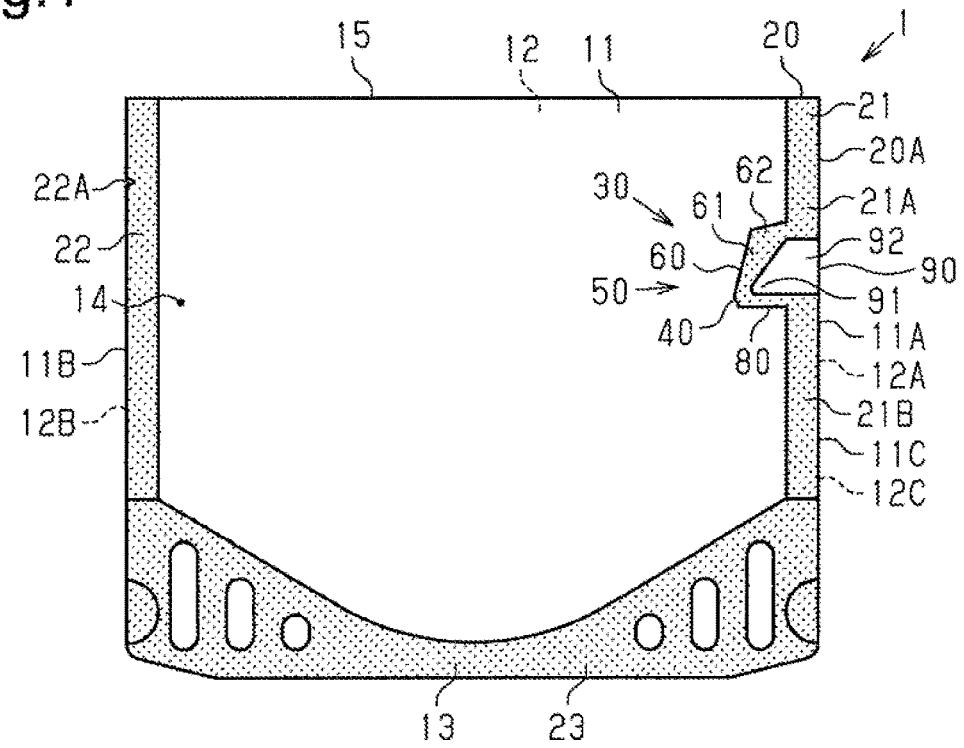
FIG. 1 is a front view of a pouch according to a first embodiment of the present disclosure in an open state.
Figure 2:
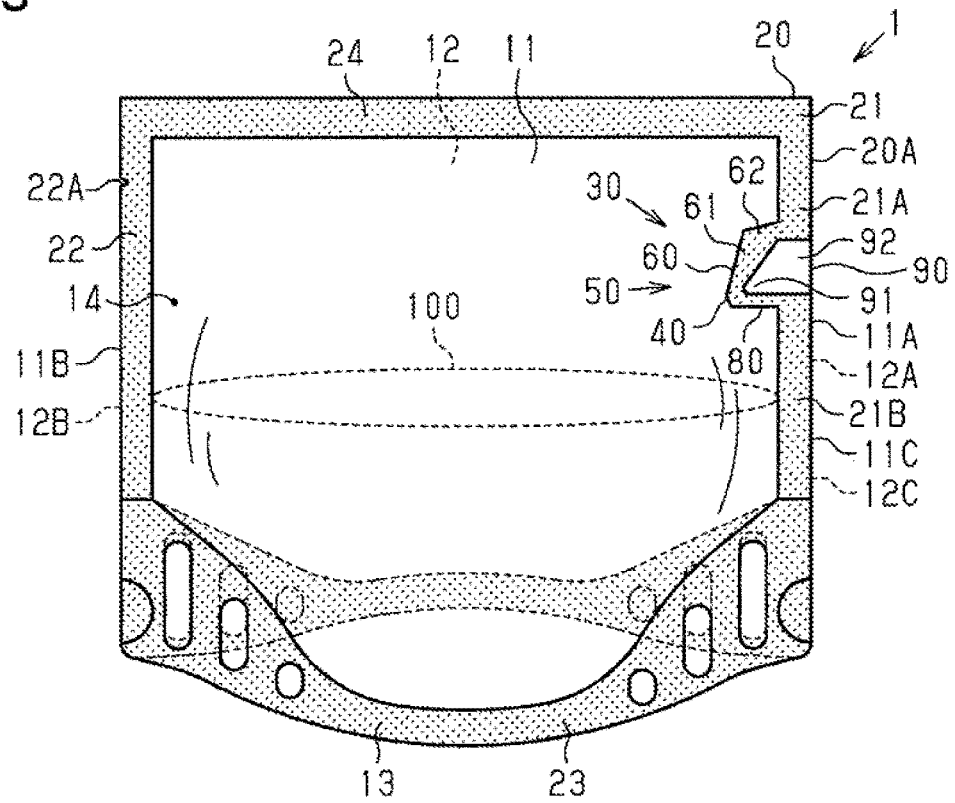
FIG. 2 is a front view of the pouch of FIG. 1 in a closed state.

FIGS. 1 and 2 show one example of a pouch 1 in accordance with a first embodiment. The pouch 1 is a so-called standing pouch. The pouch 1 can take states including at least an open state and a closed state. In another example, the pouch 1 has the form of a flat pouch. FIG. 1 shows the pouch 1 in an open state, and FIG. 2 shows the pouch 1 in a closed state. When the pouch 1 is in the open state, the pouch 1 does not contain any contents 100, and an opening 15 of the pouch 1 is open. When the pouch 1 is in the closed state, the contents 100 are contained in the pouch 1, and the opening 15 is sealed. The contents 100 include, for example, food with sauce. In one example, the pouch 1 is presented to the end user in a closed state.

As shown in FIG. 1, the pouch 1 includes a first sheet 11, a second sheet 12, and a gusset sheet 13. The first sheet 11 and the second sheet 12 are arranged one upon another as a pair of sheets. The pouch 1 includes a seal 20 that seals the sheets 11 to 13 together in the open state. The shading in FIGS. 1 to 6 indicates the sealed portions of the sheets 11 to 13.

Each of the sheets 11 to 13 have a layer structure that will now be described.

The sheets 11 to 13 each include an outermost layer, a middle layer, and an innermost layer. One example of the material forming the outermost layer is a transparent material. One example of a transparent material is polyethylene terephthalate. The middle layer includes a printed layer, a first adhesive layer, a stretched nylon layer, and a second adhesive layer. The printed layer is located at the inner side of the outermost layer. In one example, graphics, text describing the product, and the like are printed on the outer surface of the printed layer. The first adhesive layer is located at the inner side of the printed layer. The second adhesive layer is located at the inner side of the stretched nylon layer. One example of the material forming each of the adhesive layers is a dry laminate adhesive agent. The innermost layer is located at the inner side of the second adhesive layer. One example of the material forming the innermost layer is non-stretched polypropylene.

The seal 20 includes a first side seal portion 21, a second side seal portion 22, and a gusset seal portion 23. The first side seal portion 21 is one example of a first seal portion that seals one side 11A of the first sheet 11 with one side 12A of the second sheet 12. The second side seal portion 22 is a seal that seals the other side 11B of the first sheet 11 and the other side 12B of the second sheet 12. The gusset seal portion 23 is where the sheets 11 to 13 are sealed together to form the gusset seal portion 23 of the pouch 1.

The seal 20 seals the sheets 11 to 13 to form an accommodation cavity 14 between the first sheet 11 and the second sheet 12 to allow for accommodation of the contents 100. The upper portion of the pouch 1 in the open state includes the opening 15 that opens the accommodation cavity 14. The contents 100 are arranged in the accommodation cavity 14. The opening 15 is closed to seal the sheets 11 and 12 so that the pouch 1 is in the closed state shown in FIG. 2. In addition to the seal portions 21 to 23, the seal 20 of the pouch 1 in the closed state further includes an upper seal 24 that closes the opening 15.

The upper part of the second side seal portion 22 includes a notch 22A. The upper part of the pouch 1 includes a tear line (not shown) that is continuous with the notch 22A. Part of the pouch 1 is cut away from the notch 22A along the tear line to open the upper seal 24. This opens the opening 15 and defines the used state of the pouch 1. The end user can remove the contents 100 through the opening 15 when open.

The first side seal portion 21 includes an upper seal portion 21A, a lower seal portion 21B, and a steam passage seal portion 30. The upper seal portion 21A and the lower seal portion 21B seal the edges of the sheets 11 and 12. The steam passage seal portion 30 is one example of a second seal portion used to release steam, which is generated from the contents 100 when the pouch 1 is heated by a heating means in the closed state, out of the accommodation cavity 14. The steam passage seal portion 30 is continuous with the upper seal portion 21A and the lower seal portion 21B. Further, the steam passage seal portion 30 seals the side 11A of the first sheet 11 and the side 12A of the second sheet 12 together with the seal portions 21A and 21B.

Figure 3:
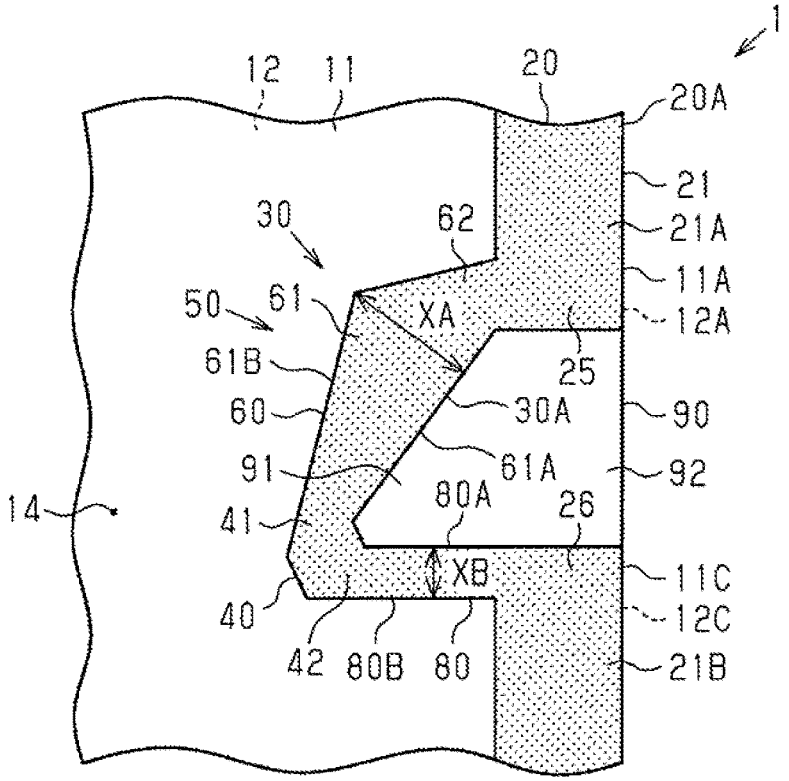
FIG. 3 is an enlarged view of a steam passage seal portion shown in FIGS. 1 and 2.
Figure 4:
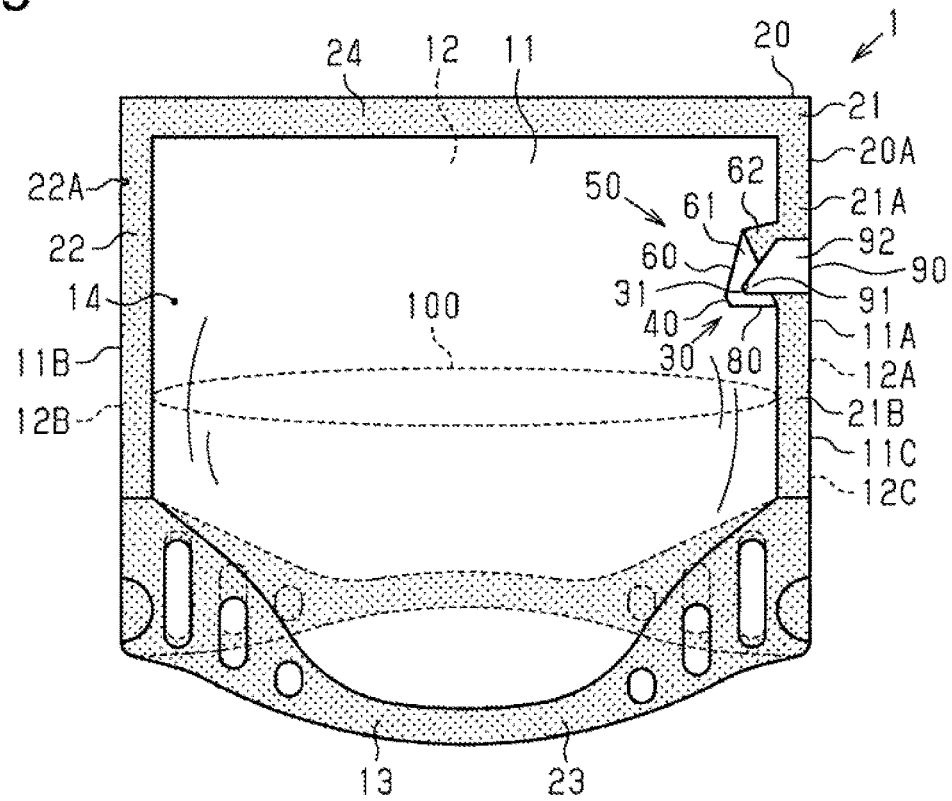
FIG. 4 is a front view of the pouch of FIG. 2 in a state in which a distal end of the steam passage seal portion is ripped.

FIG. 3 is an enlarged view of the steam passage seal portion 30. The steam passage seal portion 30 is shaped to be depressed from outer edges 11C and 12C of the sheets 11 and 12 toward the accommodation cavity 14. The steam passage seal portion 30 includes a distal end portion 40 and a connection portion 50. The distal end portion 40 is located in the sheets 11 and 12 where strong stress concentrates when the steam generated from the contents 100 of the pouch 1 in a closed state raises the pressure of the accommodation cavity 14. In one example, the steam passage seal portion 30 is configured so that the distal end portion 40 is directed toward the center of the accommodation cavity 14. Thus, as the interior pressure rises in the pouch 1 in the closed state, at least the distal end portion 40 of the steam passage seal portion 30 rips. The ripped portion forms an opening 31 (refer to FIG. 4) that connects the accommodation cavity 14 and the outside of the accommodation cavity 14.

The connection portion 50 includes a first connection portion 60 and a second connection portion 80. The first connection portion 60 connects a first end 41 of the distal end portion 40 and an end 25 (first end) of the upper seal portion 21A. The second connection portion 80 connects a second end 42 of the distal end portion 40 and an end 26 (second end) of the lower seal portion 21B.

The first connection portion 60 includes a ripping restriction portion 61 and a side end portion 62. The ripping restriction portion 61 restricts ripping of the steam passage seal portion 30 that progresses from the distal end portion 40 toward the upper seal portion 21A. The side end portion 62 connects the ripping restriction portion 61 and the upper seal portion 21A. The ripping restriction portion 61 extends from the distal end portion 40 toward the upper seal portion 21A in a state tilted toward the opening 15 with respect to the widthwise direction of the pouch 1. The side end portion 62, which connects an end of the ripping restriction portion 61 and the upper seal portion 21A, extends in an inclined state from the end of the ripping restriction portion 61 toward the upper seal portion 21A. In one example, the side end portion 62 extends in an inclined state toward the upper seal portion 21A with respect to the direction in which the ripping restriction portion 61 extends.

The ripping restriction portion 61 has a seal width XA that increases from the distal end portion 40 toward the upper seal portion 21A. The maximum dimension of the seal width XA of the ripping restriction portion 61 is set to prevent ripping of the part closer to the first side seal portion 21 than the ripping restriction portion 61 of the steam passage seal portion 30 even when the interior pressure of the accommodation cavity 14 is the highest. The second connection portion 80 extends in the widthwise direction of the pouch 1. The second connection portion 80 has a seal width XB that is constant. The seal width XA is the dimension of the ripping restriction portion 61 along a normal extending from an outer edge 61A toward an inner edge 61B of the ripping restriction portion 61. The seal width XB is the dimension of the second connection portion 80 along a normal extending from an outer edge 80A toward an inner edge 80B of the second connection portion 80.

The pouch 1 further includes a non-sealed portion 90. The non-sealed portion 90 is a portion in the sheets 11 and 12 surrounded by an outer edge 20A of the first side seal portion 21 and includes a first non-sealed portion 91 and a second non-sealed portion 92. The surfaces of the sheets 11 and 12 at the non-sealed portion 90 are not sealed with each other. The first non-sealed portion 91 corresponds to the depression of the steam passage seal portion 30 and is surrounded by an outer edge 30A of the steam passage seal portion 30. The second non-sealed portion 92 includes the outer edges 11C and 12C of the sheets 11 and 12 and is located between the end of the upper seal portion 21A and the end of the lower seal portion 21B.

One example of a method in which an end user uses the pouch 1 will now be described.

Figure 5:
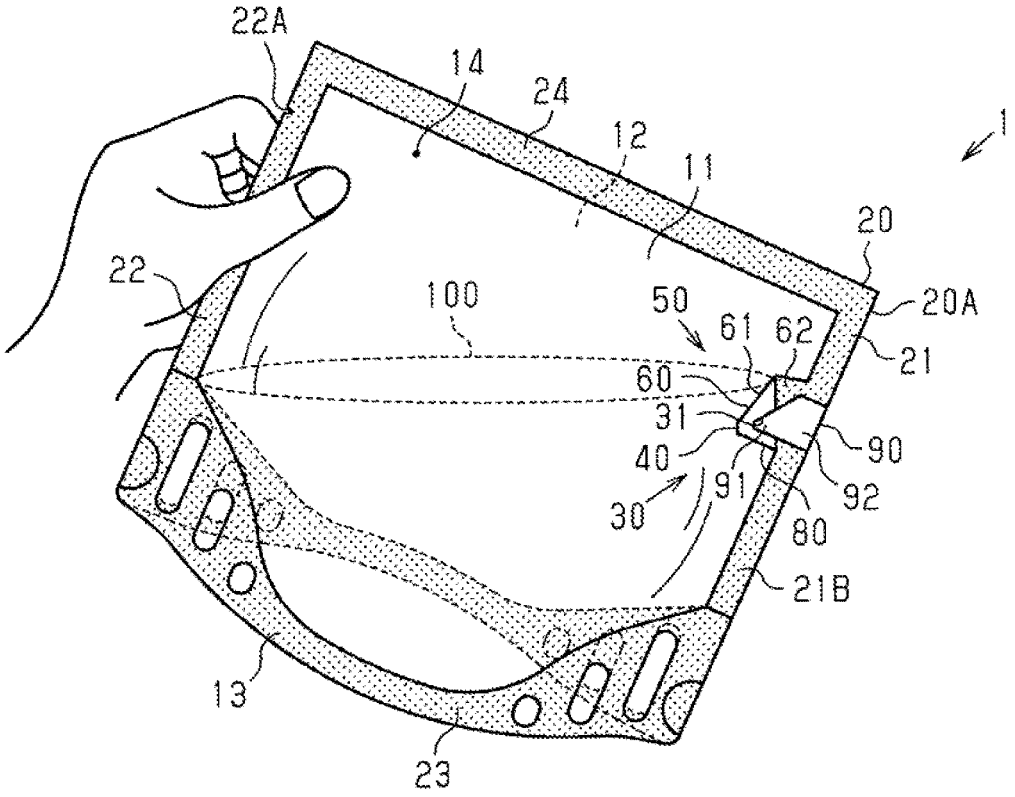
FIG. 5 is a diagram showing a state in which the pouch of FIG. 4 is tilted.
Figure 6:
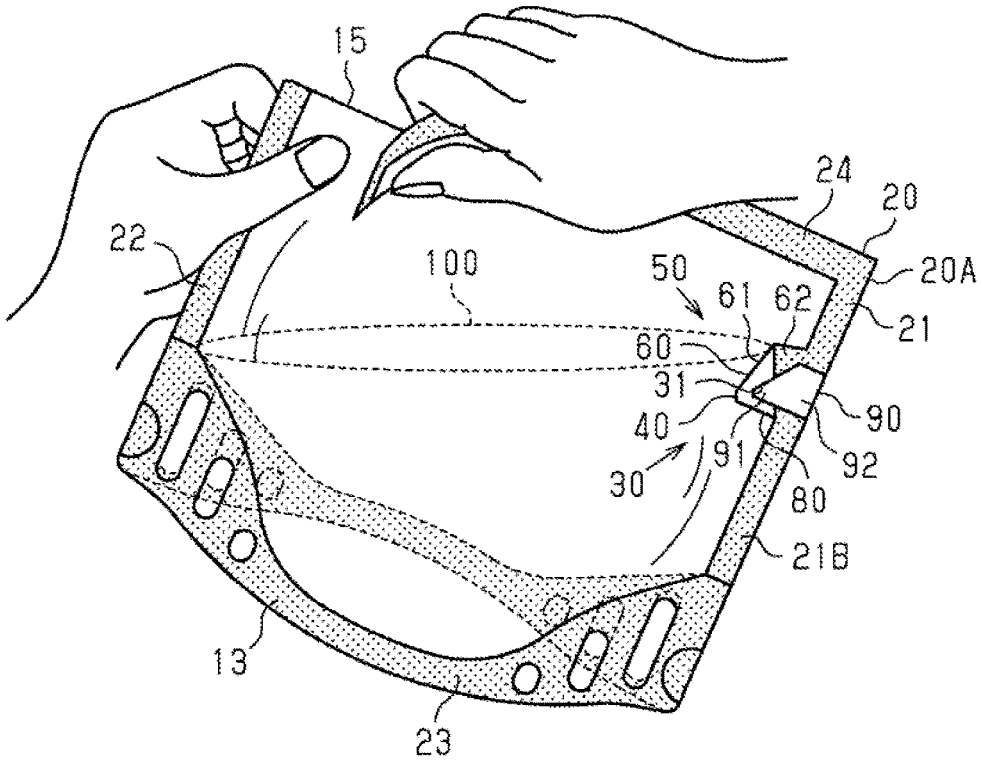
FIG. 6 is a diagram illustrating a state in which an upper seal shown in FIG. 5 is being torn.
Figure 7:
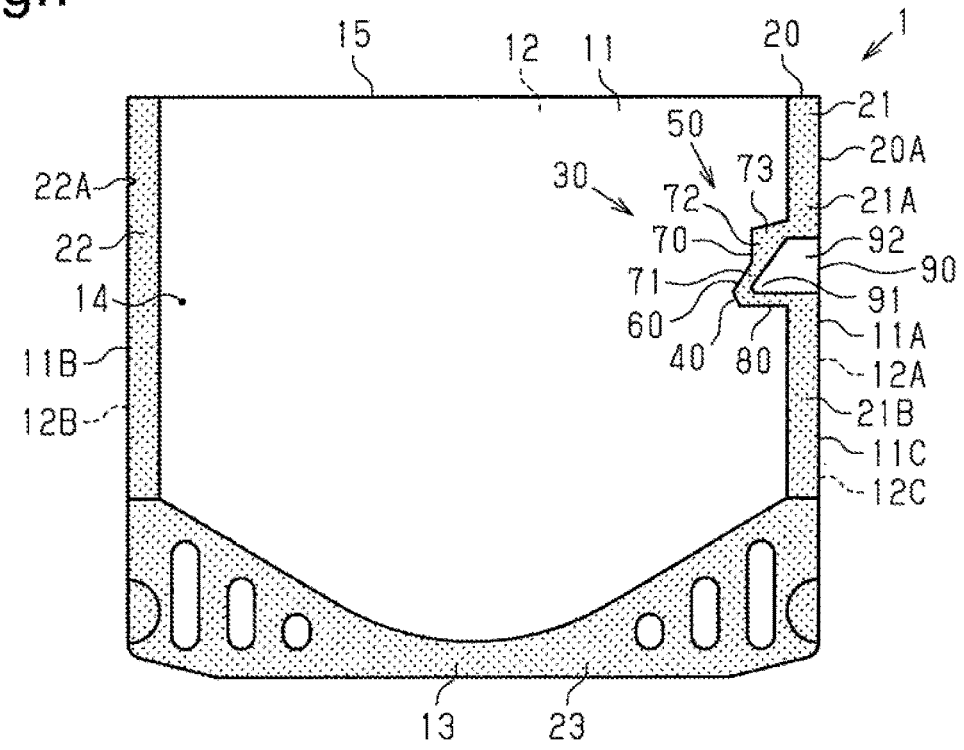
FIG. 7 is a front view of a pouch according to a second embodiment of the present disclosure in an open state.
Figure 8:
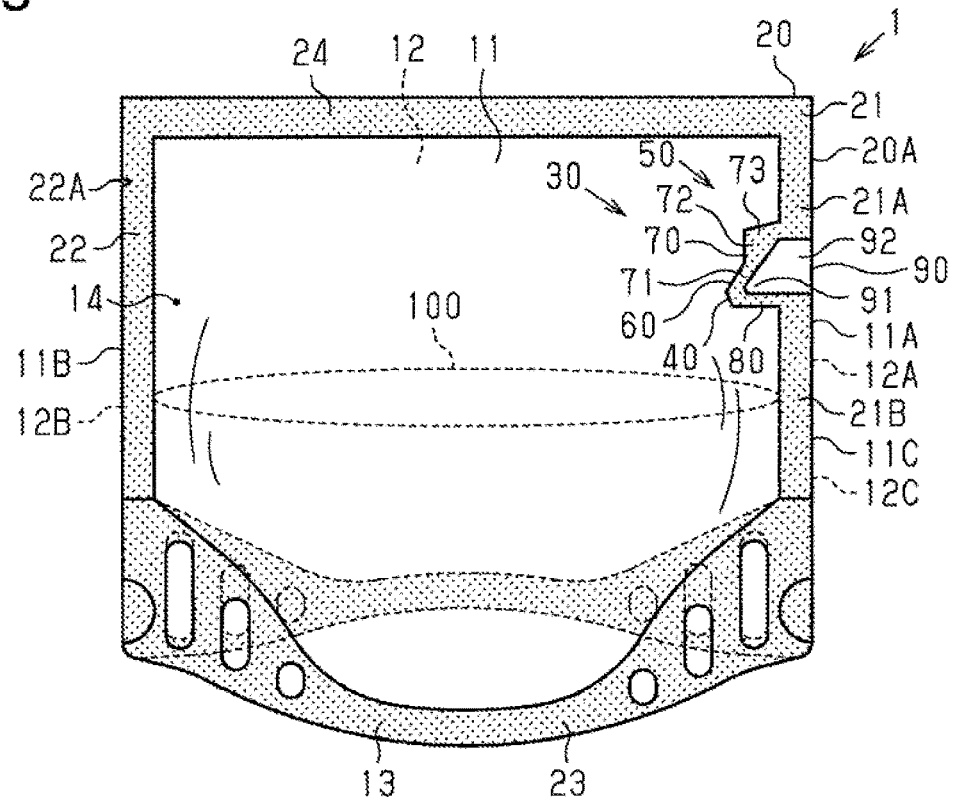
FIG. 8 is a front view of the pouch of FIG. 7 in a closed state.

First, the pouch 1 is arranged in a closed state in a heating means such as a microwave oven (not shown) and heated by the heating means. After the heating ends, the end user holds the pouch 1 as shown in FIG. 5. Then, as shown in FIG. 6, the end user tears a portion including the upper seal 24 along the notch 22A and the tear line (not shown) to open the opening 15. The contents 100 are taken out of the pouch 1 through the opening 15.

The pouch 1 in accordance with the first embodiment has the advantages described below.

When the pouch 1 is heated in a closed state by a heating means, steam generated from the contents 100 gradually raises the pressure of the accommodation cavity 14. This expands the first sheet 11 and the second sheet 12 away from each other and rips the distal end portion 40 of the steam passage seal portion 30 thereby forming the opening 31. After the distal end portion 40 rips, the ripping of the steam passage seal portion 30 progresses toward the first side seal portion 21. Since the first connection portion 60 includes the ripping restriction portion 61, the ripping of the seal, for example, at the steam passage seal portion 30 ends at the part where the seal width XA in the ripping restriction portion 61 is the greatest. When the contents 100 generate a small amount of steam, the ripping of the seal of the steam passage seal portion 30 ends at a part closer to the distal end portion 40 that the part where the seal width XA is the greatest.

The steam remaining in the accommodation cavity 14 passes through at least the opening 31 formed in the distal end portion 40 and a passage formed between the two sheets 11 and 12 at the non-sealed portion 90 and is released outward from the outer edges 11C and 12C of the sheets 11 and 12. Thus, the pouch 1 resists rupturing.

The size of the opening 31 formed in the steam passage seal portion 30 when the steam passage seal portion 30 rips is determined by the ripping restriction portion 61. This obviates the formation of an opening in the steam passage seal portion 30 having a size larger than the expected size of the opening 31. Thus, even when the pouch 1 is tilted after heating of the pouch 1 ends, a situation is avoided in which a large amount of the contents 100 leak out of the opening 31 formed in the steam passage seal portion 30. Further, when the heating of the pouch 1 ends, the surfaces of the sheets 11 and 12 forming the non-sealed portion 90 come into contact with each other because of the steam. Thus, even if the contents 100 pass through the opening 31 formed in the steam passage seal portion 30, movement of the contents 100 is hindered by the non-sealed portion 90 where the contact is occurring. This limits the leakage of the contents 100 out of the outer edges 11C and 12C of the sheets 11 and 12.

Further, the seal width XA of the ripping restriction portion 61 gradually increases from the distal end portion 40 toward the upper seal portion 21A. Thus, as the ripping of the ripping restriction portion 61 progresses, local concentration of stress at the ripping restriction portion 61 is limited, and the ripping progresses stably until the ripping restriction portion 61 restricts the ripping.

The side end portion 62 extends in an inclined state from the end of the ripping restriction portion 61 toward the upper seal portion 21A. This obtains a wide region in the first sheet 11 and the second sheet 12 for forming a tear line or the like upward from the steam passage seal portion 30.

Modified Example

The description related with the first embodiment exemplifies, without any intention to limit, an applicable form of a pouch according to the present disclosure. The pouch according to the present disclosure is applicable to, for example, modified examples of the first embodiment that are described below and combinations of at least two of the modified examples that do not contradict each other.

The shape of the steam passage seal portion 30 may be changed. In a first example, the side end portion 62 is omitted from the first connection portion 60. Further, the ripping restriction portion 61 is continuous with the upper seal portion 21A. The seal width XA of the ripping restriction portion 61 increases from the distal end portion 40 toward the upper seal portion 21A. In a second example, a seal portion that differs in shape from the ripping restriction portion 61 is arranged between the distal end portion 40 and the ripping restriction portion 61. The seal portion is shaped to have, for example, a constant seal width or a seal width that decreases from the distal end portion 40 toward the ripping restriction portion 61. In a third example, in addition to the first connection portion 60, the second connection portion 80 also includes a ripping restriction portion. The ripping restriction portion of the second connection portion 80 is shaped, for example, in correspondence with the shape of the ripping restriction portion 61 of the first connection portion 60. In a fourth example, only the second connection portion 80 includes a ripping restriction portion.

The configuration of the sheets 11 to 13 may be changed in any manner. In a first example, a single sheet is folded to form the first sheet 11 and the second sheet 12. In a second example, a single sheet is folded to form the sheets 11 to 13.

Second Embodiment

One example of the pouch 1 in accordance with a second embodiment will now be described with reference to FIGS. 7 to 12. The pouch 1 of the second embodiment differs in shape of the steam passage seal portion 30, especially, the shape of the connection portion 50, from the pouch 1 of the second embodiment. Parts corresponding to the first embodiment will not be described below.

Figure 9:
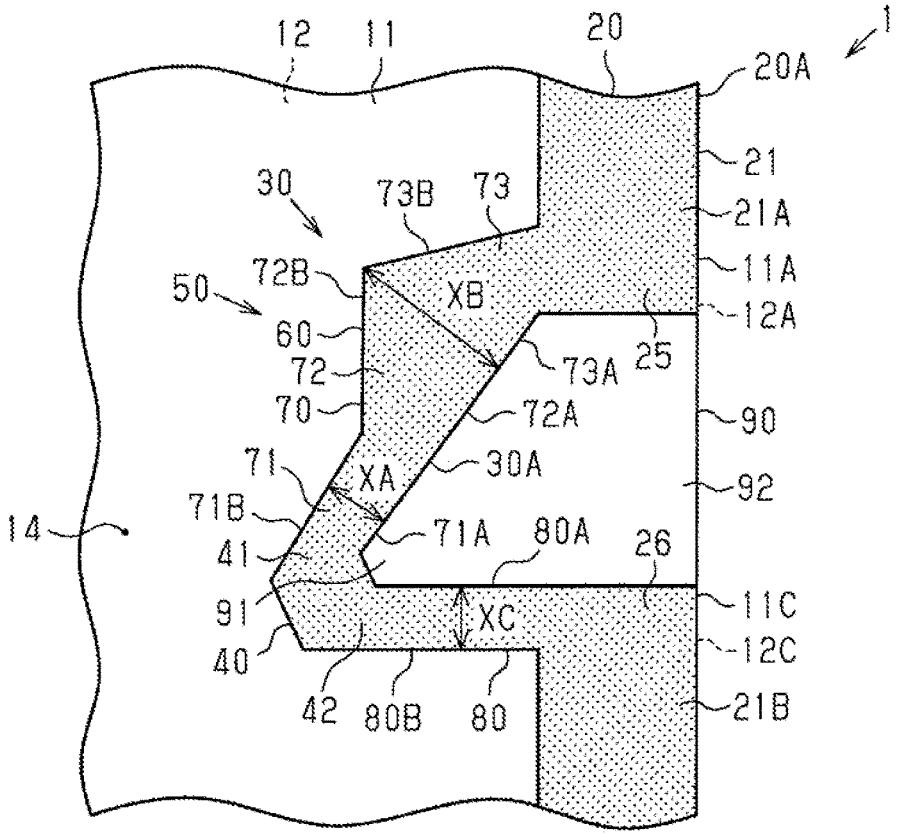
FIG. 9 is an enlarged view of a steam passage seal portion shown in FIGS. 7 and 8.
Figure 10:
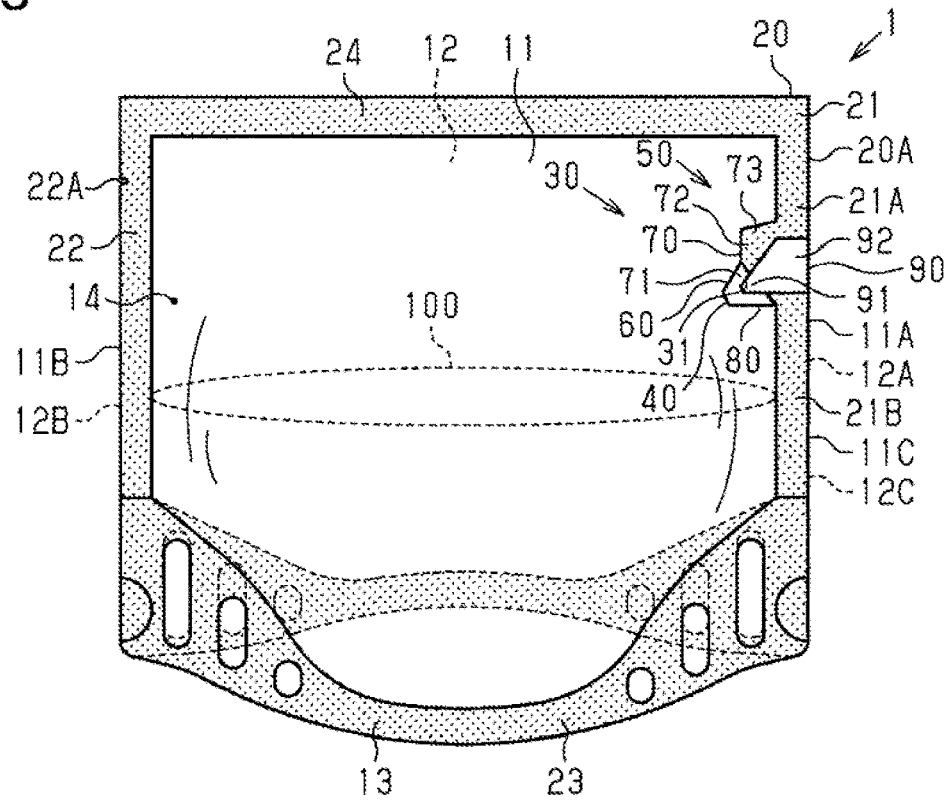
FIG. 10 is a diagram of the pouch of FIG. 8 in a state in which a distal end of the steam passage seal portion is open.

As shown in FIG. 9, in the second embodiment, the connection portion 50 includes the first connection portion 60, which connects the first end 41 of the distal end portion 40 and the end 25 (first end) of the upper seal portion 21A, and the second connection portion 80, which connects the second end 42 of the distal end portion 40 and the end 26 (second end) of the lower seal portion 21B.

The first connection portion 60 includes a ripping restriction portion 70 and a side end portion 73. The ripping restriction portion 70 restricts ripping of the steam passage seal portion 30 that progresses from the distal end portion 40 toward the upper seal portion 21A. The side end portion 73 connects the ripping restriction portion 70 and the upper seal portion 21A. The ripping restriction portion 70 extends from the distal end portion 40 toward the upper seal portion 21A in a state inclined toward the opening 15 with respect to the widthwise direction of the pouch 1.

The ripping restriction portion 70 includes a first portion 71, which is continuous with the first end 41 of the distal end portion 40 and has a constant seal width XA, and a second portion 72, which is continuous with the first portion 71 and has a seal width XB that increases from the distal end portion 40 toward the upper seal portion 21A. The seal width XA is the dimension of the first portion 71 along a normal extending from an outer edge 71A to an inner edge 71B of the first portion 71. The seal width XB is the dimension of the second portion 72 along a normal extending from an outer edge 72A to an inner edge 72B of the second portion 72. The outer edge 72A of the second portion 72 extends in the same direction as the outer edge 71A of the first portion 71. The inner edge 72B of the second portion 72 extends along the first side seal portion 21.

The side end portion 73 connects the second portion 72 where the seal width XB is the greatest to the end 25 of the upper seal portion 21A. An outer edge 73A of the side end portion 73 extends in the same direction as the outer edge 72A of the second portion 72. An inner edge 73B of the side end portion 73 extends diagonally from the inner edge 72B of the second portion 72 to approach the upper seal portion 21A. In one example, the inner edge 73B extends in an inclined state with respect to the direction in which the inner edge 72B extends.

The second connection portion 80 extends in a widthwise direction of the pouch 1. The second connection portion 80 has a seal width XC that is constant. The seal width XC is the dimension of the second connection portion 80 from the outer edge 80A to the inner edge 80B of the second connection portion 80.

The pouch 1 further includes the non-sealed portion 90. The non-sealed portion 90 is a portion in the sheets 11 and 12 surrounded by the outer edge 20A of the first side seal portion 21 and includes the first non-sealed portion 91 and the second non-sealed portion 92. The surfaces of the sheets 11 and 12 at the non-sealed portion 90 are not sealed with each other. The first non-sealed portion 91 corresponds to the depression of the steam passage seal portion 30 and is surrounded by the outer edge 30A of the steam passage seal portion 30. The second non-sealed portion 92 is a portion in the sheets 11 and 12 surrounded by the outer edges 11C and 12C and located between an end of the upper seal portion 21A and an end of the lower seal portion 21B.

One example of a method in which an end user uses the pouch 1 will now be described.

Figure 11:
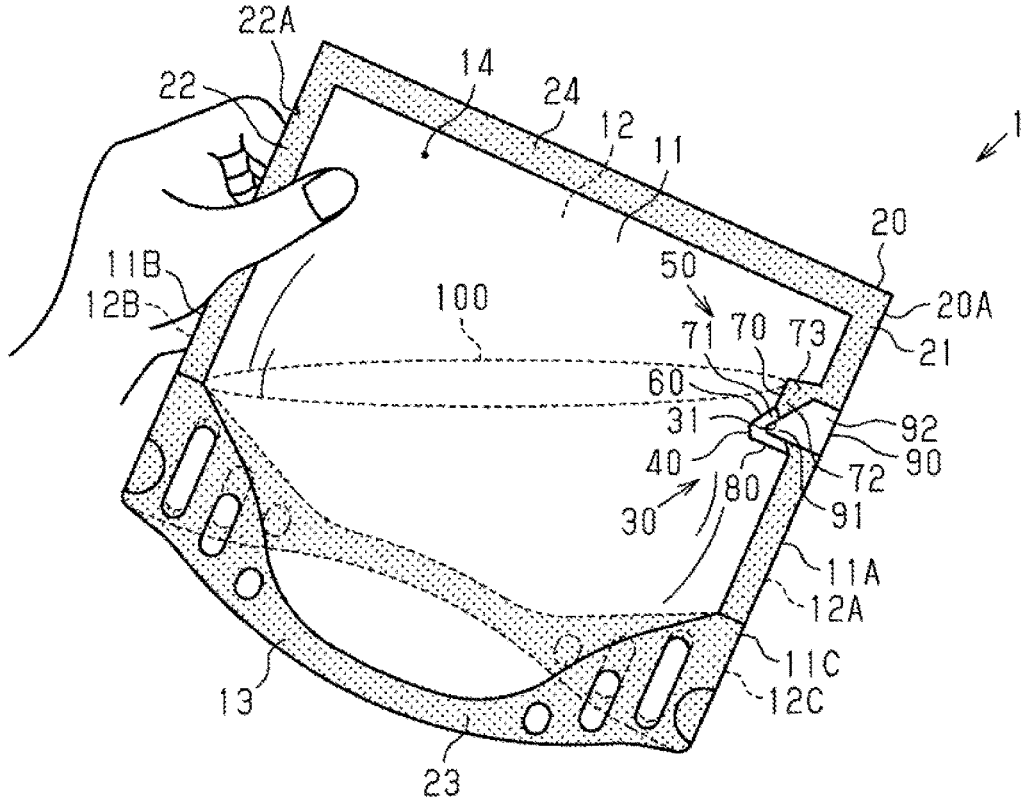
FIG. 11 is a diagram showing a state in which the pouch of FIG. 10 is tilted.
Figure 12:
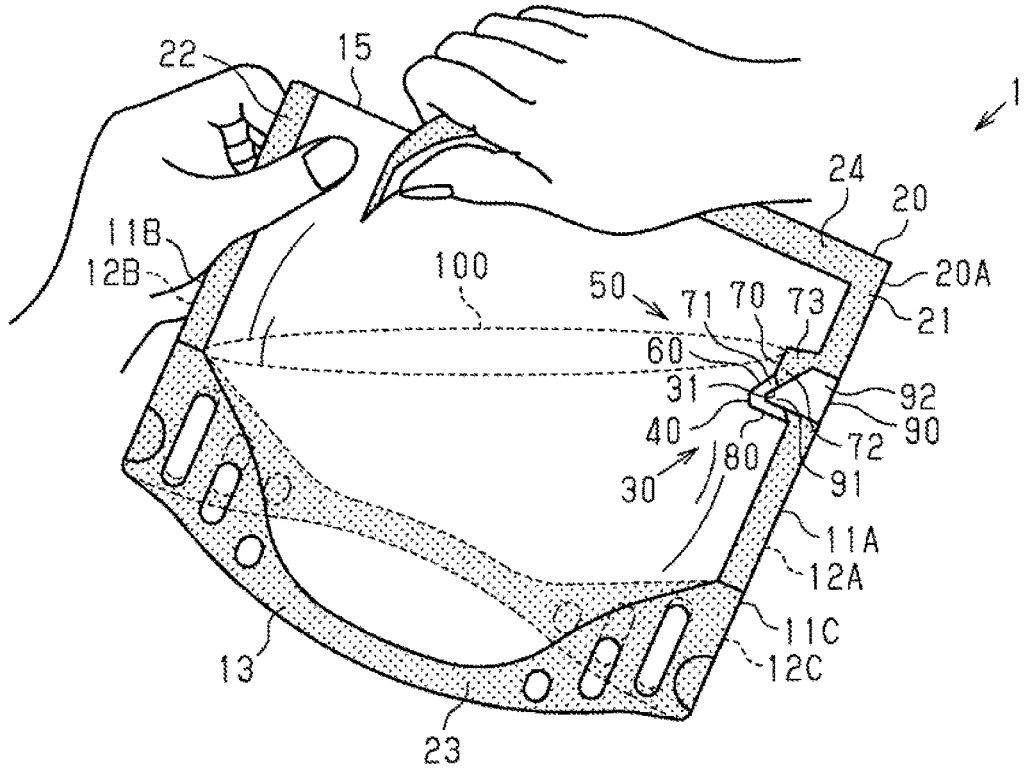
FIG. 12 is a diagram illustrating a state in which an upper seal shown in FIG. 11 is being torn.

First, the pouch 1 is arranged in a closed state in a heating means such as a microwave oven (not shown) and heated by the heating means. After the heating ends, the end user holds the pouch 1 as shown in FIG. 11. Then, as shown in FIG. 12, the end user tears a portion including the upper seal 24 along the notch 22A and the tear line (not shown) to open the opening 15. The contents 100 are taken out of the pouch 1 through the opening 15.

The pouch 1 in accordance with the second embodiment has the advantages described below.

When the pouch 1 is heated in a closed state by a heating means, steam generated from the contents 100 gradually raises the pressure of the accommodation cavity 14. This expands the first sheet 11 and the second sheet 12 away from each other and rips the distal end portion 40 of the steam passage seal portion 30 thereby forming the opening 31 (refer to FIG. 10). After the distal end portion 40 rips, the ripping of the steam passage seal portion 30 progresses toward the first side seal portion 21. Since the first connection portion 60 includes the ripping restriction portion 70, the ripping of the seal ends at, for example, the boundary of the first portion 71 and the second portion 72 in the ripping restriction portion 70.

The steam remaining in the accommodation cavity 14 passes through at least the opening 31 formed in the distal end portion 40 and a passage formed between the two sheets 11 and 12 at the non-sealed portion 90 and is released outward from the outer edges 11C and 12C of the sheets 11 and 12. Thus, the pouch 1 resists rupturing.

The size of the opening 31 formed in the steam passage seal portion 30 when the steam passage seal portion 30 rips is determined by the ripping restriction portion 70. This obviates the formation of an opening in the steam passage seal portion 30 having a size larger than the expected size of the opening 31. Thus, even when the pouch 1 is tilted after heating of the pouch 1 ends, a situation is avoided in which a large amount of the contents 100 leak out of the opening 31 formed in the steam passage seal portion 30. Further, when the heating of the pouch 1 ends, the surfaces of the sheets 11 and 12 forming the non-sealed portion 90 come into contact with each other because of the steam. Thus, even if the contents 100 pass through the opening 31 formed in the steam passage seal portion 30, movement of the contents 100 is hindered by the non-sealed portion 90 where the contact is occurring. This limits the leakage of the contents 100 out of the outer edges 11C and 12C of the sheets 11 and 12.

Further, the seal width XB of the ripping restriction portion 70 gradually increases from the distal end portion 40 toward the upper seal portion 21A. Thus, as the ripping of the ripping restriction portion 70 progresses, local concentration of stress at the ripping restriction portion 70 is limited, and the ripping progresses stably until the ripping restriction portion 70 restricts the ripping.

The inner edge 73B of the side end portion 73 extends in an inclined state from the inner edge 72B of the second portion 72 toward the upper seal portion 21A. This obtains a wide region in the first sheet 11 and the second sheet 12 for forming a tear line or the like upward from the steam passage seal portion 30.

Modified Example

The description related with the second embodiment exemplifies, without any intention to limit, an applicable form of a pouch according to the present disclosure. The pouch according to the present disclosure is applicable to, for example, modified examples of the second embodiment that are described below and combinations of at least two of the modified examples that do not contradict each other.

The shape of the steam passage seal portion 30 may be changed. In a first example, the side end portion 73 is omitted from the first connection portion 60. Further, the ripping restriction portion 70 is continuous with the upper seal portion 21A. The seal width XA of the ripping restriction portion 61 increases from the distal end portion 40 toward the upper seal portion 21A. The seal width XB of the ripping restriction portion 70 increases from the distal end portion 40 toward the upper seal portion 21A. In a second example, the first portion 71 of the ripping restriction portion 70 is shaped so that the seal width XA decreases from the distal end portion 40 toward the second portion 72. In a third example, in addition to the first connection portion 60, the second connection portion 80 also includes a ripping restriction portion. The ripping restriction portion of the second connection portion 80 is shaped, for example, in correspondence with the shape of the ripping restriction portion 70 of the first connection portion 60. In a fourth example, only the second connection portion 80 includes a ripping restriction portion.

The configuration of the sheets 11 to 13 may be changed in any manner. In a first example, a single sheet is folded to form the first sheet 11 and the second sheet 12. In a second example, a single sheet is folded to form the sheets 11 to 13.

The invention claimed is:

1. A pouch comprising:

two sheets placed one upon another;

a seal including a first seal portion and a second seal portion, wherein the first seal portion extends along an edge of the two sheets and seals the two sheets together to form an accommodation cavity between the two sheets that allows for accommodation of contents, and the second seal portion is shaped to be depressed toward the accommodation cavity; and a non-sealed portion that is a portion in the two sheets surrounded by the second seal portion and not sealed, wherein the second seal portion includes a distal end portion and a connection portion, the distal end portion is configured to be ripped by stress concentration that occurs when steam generated from the contents raises pressure of the accommodation cavity, the connection portion is configured to connect the distal end portion and the first seal portion, the connection portion includes a ripping restriction portion configured to restrict ripping of the second seal portion that progresses from the distal end portion toward the first seal portion, the connection portion includes a first connection portion and a second connection portion, the first connection portion is configured to connect a first end of the distal end portion and a first end of the first seal portion, the second connection portion is configured to connect a second end of the distal end portion and a second end of the first seal portion, one of the first connection portion and the second connection portion includes the ripping restriction portion, and the other one of the first connection portion and the second connection portion does not include the ripping restriction portion.

2. The pouch according to claim 1, wherein the ripping restriction portion includes a part having a larger seal width than the distal end portion.

3. The pouch according to claim 2, wherein the ripping restriction portion has a seal width that increases from the distal end portion toward the first seal portion.

4. The pouch according to claim 1, wherein the second seal portion is configured so that the distal end portion is directed toward a center of the accommodation cavity.

5. The pouch according to claim 1, further comprising the contents arranged in the accommodation cavity.

6. The pouch according to claim 1, wherein the ripping restriction portion includes a part having a larger seal width than the distal end portion, and the ripping restriction portion has a seal width that increases from the distal end portion toward the first seal portion.

7. A pouch comprising:

two sheets placed one upon another;

a seal including a first seal portion and a second seal portion, wherein the first seal portion extends along an edge of the two sheets and seals the two sheets together to form an accommodation cavity between the two sheets that allows for accommodation of contents, and the second seal portion is shaped to be depressed toward the accommodation cavity; and a non-sealed portion that is a portion in the two sheets surrounded by the second seal portion and not sealed, wherein the second seal portion includes a distal end portion and a connection portion, the distal end portion is configured to be ripped by stress concentration that occurs when steam generated from the contents raises pressure of the accommodation cavity, the connection portion is configured to connect the distal end portion and the first seal portion, the connection portion includes a ripping restriction portion configured to restrict ripping of the second seal portion that progresses from the distal end portion toward the first seal portion, the ripping restriction portion includes a part having a larger seal width than the distal end portion, the ripping restriction portion has a seal width that increases from the distal end portion toward the first seal portion, and an inner edge of the ripping restriction portion includes a part that extends along the first seal portion.

8. The pouch according to claim 7, wherein the connection portion includes a first connection portion and a second connection portion, the first connection portion is configured to connect a first end of the distal end portion and a first end of the first seal portion, the second connection portion is configured to connect a second end of the distal end portion and a second end of the first seal portion, one of the first connection portion and the second connection portion includes the ripping restriction portion, and the other one of the first connection portion and the second connection portion does not include the ripping restriction portion.

9. The pouch according to claim 7, wherein the second seal portion is configured so that the distal end portion is directed toward a center of the accommodation cavity.

10. The pouch according to claim 7, further comprising the contents arranged in the accommodation cavity.

* * * * *